US007828158B2

(12) United States Patent
Colelli et al.

(10) Patent No.: US 7,828,158 B2
(45) Date of Patent: Nov. 9, 2010

(54) MERCHANDISE DISPENSING APPARATUS PROVIDING THEFT DETERRENCE

(75) Inventors: Robert P. Colelli, Yorba Linda, CA (US); Eric E. Oberg, Long Beach, CA (US); Johnnie Cruz, Anaheim, CA (US); Keith Cleland, Costa Mesa, CA (US)

(73) Assignee: Displays Plus, Inc., Placentia, CA (US)

( * ) Notice: Subject to any disclaimer, the term of this patent is extended or adjusted under 35 U.S.C. 154(b) by 63 days.

(21) Appl. No.: 11/899,040

(22) Filed: Sep. 1, 2007

(65) Prior Publication Data

US 2008/0245811 A1 Oct. 9, 2008

Related U.S. Application Data

(63) Continuation-in-part of application No. 11/457,792, filed on Jul. 14, 2006, now abandoned.

(60) Provisional application No. 60/699,288, filed on Jul. 14, 2005.

(51) Int. Cl.
*A47F 7/00* (2006.01)

(52) U.S. Cl. ..... 211/59.3

(58) Field of Classification Search ..... 211/59.3, 211/59.4, 184, 51; 312/126, 71; 221/75, 221/76, 13, 90, 242
See application file for complete search history.

(56) References Cited

U.S. PATENT DOCUMENTS 2,806,631 A * 9/1957 Van Vactor ..... 221/13
2,980,259 A * 4/1961 Fowlds ..... 211/59.3
3,083,067 A * 3/1963 Vos et al. ..... 312/71
3,579,952 A * 5/1971 Davies et al. ..... 53/467
3,942,649 A * 3/1976 Hugelman et al. ..... 414/676
4,122,939 A * 10/1978 Langen ..... 198/476.1
4,487,024 A * 12/1984 Fletcher et al. ..... 62/3.63
4,729,481 A * 3/1988 Hawkinson et al. ..... 211/59.3
4,744,490 A * 5/1988 Albright et al. ..... 221/75
4,830,201 A 5/1989 Breslow
4,944,414 A 7/1990 Albright
5,174,470 A * 12/1992 North et al. ..... 221/150 HC
5,307,941 A * 5/1994 Siegal ..... 211/11
5,385,266 A * 1/1995 Pate ..... 221/76
5,407,085 A 4/1995 Goldring et al.
5,456,370 A 10/1995 Goldring et al.

(Continued)

FOREIGN PATENT DOCUMENTS

WO WO 02/091885 11/2002

*Primary Examiner*—Sarah Purol
(74) *Attorney, Agent, or Firm*—Vista IP Law Group LLP

(57) ABSTRACT

A box structure has a plurality of walls positioned and configured to prevent access to an interior space housing merchandise in a secure manner. A first movable wall permits manual access to a frontal portion of the interior space while at the same time moving a barrier strip to prevent manual access to other than said frontal portion of the interior space. A roll-out shelf mounts merchandise supporting modules with pushers to move merchandise toward the front of the structure where ejection mechanisms in each of the modules are able to direct selected items to the front of the structure where they can be accessed by consumers. The ejection process creates a characteristic noise to alert store personnel that products are being dispensed.

20 Claims, 11 Drawing Sheets

U.S. PATENT DOCUMENTS 5,485,928 A 1/1996 Felton
5,505,315 A * 4/1996 Carroll ..... 211/59.2
5,605,237 A * 2/1997 Richardson et al. ..... 211/59.3
5,609,268 A * 3/1997 Shaw ..... 221/2
5,647,507 A * 7/1997 Kasper ..... 221/151
5,649,641 A * 7/1997 Campoli ..... 221/197
5,665,304 A * 9/1997 Heinen et al. ..... 312/71
5,753,897 A * 5/1998 Kasper ..... 235/380
5,829,631 A * 11/1998 Kasper ..... 221/198
5,855,281 A 1/1999 Rabas
5,857,588 A * 1/1999 Kasper ..... 221/274
5,918,954 A * 7/1999 Papadakis et al. ..... 312/126
6,012,604 A * 1/2000 Takahashi et al. ..... 221/242
6,041,720 A 3/2000 Hardy
6,193,085 B1 * 2/2001 Nook et al. ..... 211/187
6,401,942 B1 * 6/2002 Eckert ..... 211/59.3
6,578,735 B1 * 6/2003 Mothwurf ..... 221/255
6,745,906 B1 6/2004 Nagel
6,749,071 B2 6/2004 Caterinacci
6,769,552 B1 8/2004 Thalenfeld
6,889,854 B2 * 5/2005 Burke ..... 211/59.3
6,929,179 B2 * 8/2005 Fulcher et al. ..... 235/381
7,016,861 B2 * 3/2006 Mothwurf ..... 705/14
7,100,792 B2 * 9/2006 Hunter et al. ..... 221/9
7,258,247 B2 * 8/2007 Marquez ..... 221/2
7,389,886 B2 * 6/2008 Hardy et al. ..... 211/59.3
2002/0084280 A1 * 7/2002 Haven et al. ..... 221/242
2003/0089731 A1 * 5/2003 Mayer et al. ..... 221/279
2004/0040975 A1 * 3/2004 Hunter et al. ..... 221/92
2005/0056602 A1 * 3/2005 Hardy ..... 211/59.3
2005/0098515 A1 * 5/2005 Close ..... 211/59.3
2005/0161420 A1 7/2005 Hardy et al.
2005/0194396 A1 * 9/2005 Marquez ..... 221/129
2006/0086680 A1 * 4/2006 Burke ..... 211/59.3
2006/0240398 A1 10/2006 Hardy et al.
2007/0080123 A1 4/2007 Mason
2008/0006647 A1 * 1/2008 Hunter et al. ..... 221/1
2008/0011765 A1 * 1/2008 Marquez ..... 221/12
2008/0061015 A1 * 3/2008 Hardy et al. ..... 211/59.3
2008/0135507 A1 * 6/2008 Hardy et al. ..... 211/59.3
2008/0245811 A1 * 10/2008 Colelli et al. ..... 221/90
2008/0283477 A1 * 11/2008 Wamsley et al. ..... 211/4
2008/0314847 A1 * 12/2008 Colelli ..... 211/59.3

* cited by examiner

MERCHANDISE DISPENSING APPARATUS PROVIDING THEFT DETERRENCE

CROSS-REFERENCE TO RELATED APPLICATIONS

This is a continuation-in-part application of U.S. patent application Ser. No. 11/457,792, filed Jul. 14, 2006, now abandoned revival from unintentional abandonment, filed concurrently, and is related to subject matter contained in U.S. Provisional application 60699288 filed Jul. 14, 2005 now expired but incorporated in said U.S. Pat. No. 11/457,792 application and therefore incorporated herein by reference. The priority date of Jul. 14, 2006 is hereby claimed herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to merchandise dispensing machines such as soda, coffee, cigarette and candy machines, and more particularly to a dispending machine for retail venues where large-scale theft of merchandises displayed on open shelves is problematic.

2. Description of Related Art Including Information Disclosed Under 37 CFR 1.97 and 1.98

The references to Hardy, et al described below present a well rounded background of the subject matter of the present invention and of the serious need, that is, the motivation to establish an advanced merchandise product dispenser for retail stores. Product dispensing machines, i.e., vending machines, are very well known and up until the present have been designed for storing products of all kinds and for dispensing such products to consumers in exchange for currency without vendor attention. Vending machines are essentially vaults which store inserted currency and products for sale. As such they are expensive to provide and to operate and are not easy to use for all types of products. Recently, retail stores that traditionally display products on open shelves have experienced product theft by "sweeping," a technique used by thieves wherein products for sale that are displayed on open shelves are swept, using an arm motion moving over the shelf to push a large quantity of product into waiting bags. Often these products do not have significant value, but will provide income to the thief upon resale in a gray or black market. A new generation of merchandise dispensing machines, represented by the following prior art has been developed to specifically deal with the theft of items which are displayed on open shelves. Such machines dispense products in a similar manner as coin operated vending machines, but without the need for the consumer to place currency in the machine to operate it. Its primary purpose is to thwart theft.

Hardy, et al., U.S. 2005/0161420, discloses a system for managing and securing product and deterring theft in a retail setting that includes a system that resides either on a standard retailer shelf or may be a stand-alone system. In an embodiment, the system includes a plurality of shelves and product dividers positioned between the shelves and extending from the front edges of the shelves toward the rear of the shelves. Front retaining walls are positioned at the front edges of the shelves and are configured to have a height that inhibits access to products on the shelves. Individual retaining tabs of varying height may be added in front of rows of taller product to inhibit access to these products. In an embodiment, rigid or moveable barriers may be positioned above retaining walls that further restrict access to the products. With the invention, the "sweeping" of numerous products by a thief is deterred. In another embodiment, an alert device may be configured to detect and monitor movement of the moveable barriers and may provide an alert signal corresponding to the management of product on the shelf or corresponding to a potential theft situation. In an embodiment, the alert device may communicate with a security camera to monitor the vicinity and provide a notification to the potential thief that his actions are being monitored and recorded, or provide a notification to store computer, pager, cellular telephone, or the like.

Hardy, et al., U.S. 2006/0240398, discloses a system for managing and securing product and deterring theft in a retail setting that resides either on a standard retailer shelf or may be a stand-alone system. The system includes shelves, product dividers and front retaining walls of a height and position to inhibit access to displayed products. Individual taller retaining tabs may be added in front of taller product to inhibit access. Rigid or moveable barriers may be positioned above retaining walls to further restrict access. With the invention, the "sweeping" of numerous products by a thief is deterred. An alert device may be configured to detect and monitor movement of the moveable barriers and to provide an alert signal corresponding to the management of product or to a potential theft situation. The alert device may communicate with a security camera to monitor the vicinity and provide a notification to store computer, pager, cellular telephone, or the like.

Mason, U.S. 2007/0080123, discloses a shelf unit for displaying products in a space saving manner that includes brackets for securing to a support and a tray extending between the brackets. The tray has a front portion with edges arranged so that adjacent edges are disposed at alternating angles to form a sawtooth pattern. A face portion configured to conform to the front portion is disposed over the front portion and has a window for viewing a product disposed behind the window. Adjustable partitions are disposed on the tray and define rows for displaying the products. A biasing mechanism biases the products in the row toward a front of the shelf unit. Each biasing mechanisms has a biasing element and a slidable product advancing member. The products are arranged in adjacent rows at alternating angles to form a sawtooth pattern corresponding to the edges of the front portion of the tray.

Breslow, U.S. Pat. No. 4,830,201, discloses a shelf divider system comprising a divider wall mountable in a channel member secured to the front of a shelf. A spring-urged pusher member is slidably mounted on a track having a pair of rails integral with the divider shaft. In one embodiment, the operationally mounted divider wall is vertically oriented and the pusher member extends horizontally therefrom so that displayed merchandise resets directly on the shelf surface but is automatically urged forwardly by the retracted pusher member. In another embodiment, the track provides the supporting surface for displayed merchandise and a vertical divider wall is integrally formed with the track.

Albright, U.S. Pat. No. 4,944,414, discloses an imposed shelf arrangement for vending tubular products such as cans and the like comprising a tray having a base, a rear panel and a pair of side panels or dividers forming a longitudinally disposed product feed trough having a width equal substantially to twice the length of a tubular product; a helix disposed centrally within the feed trough and adapted to receive a plurality of tubular products between the convolutions thereof in a staggered relationship whereby the inner end of each tubular product is adapted to be disposed along the longitudinal axis of the trough; and a drive unit at the rear of the base for rotating the helix whereby to advance the tubular products one by one to the front edge of the base to drop to a delivery position.

Goldring, et al., U.S. Pat. No. 5,407,085, discloses an adjustable tilt construction for a display rack. The rear wall of the rack is provided with one or more T slots, each slot receiving one of the two parallel flanges of a respective leg, the latter generally H shaped in transverse cross section over at least a portion of its length. One flange of each leg is shorter than the other, and is asymmetrically located with respect to it so as to yield two different distances from the ends of the shorter flange to respective ends of the longer flange. This leg configuration permits three different leg heights by inserting each leg into a respective slot in three different ways. In turn, this permits three different tilt angles for the display rack. The leg and slot configuration may also be used on a table to provide height adjustment, the legs and slots operating in the same manner as in the display rack.

Goldring, et al., U.S. Pat. No. 5,456,370, discloses an adjustable tilt construction for a toothbrush display rack. The rear wall of the rack is provided with one or more T slots, each slot receiving one of two parallel flanges of a respective leg, said leg being generally H shaped in transverse cross section over at least a portion of its length. One flange of each leg is shorter than the other, and is asymmetrically located with respect to it so as to yield two different distances from the ends of the shorter flange to respective ends of the longer flange. This leg configuration permits three different leg heights by inserting each leg into a respective slot in three different ways. In turn, this permits three different tilt angles for the display rack. Each leg has at least one end having biased edges which releasably frictionally fit into the T shaped slots on the rear wall of the rack. The leg and slot configuration may also be used on any member to provide height adjustment.

Felton, U.S. Pat. No. 5,485,928, discloses a merchandise display rack that has compartments for displaying products. Each such compartment has a rear panel, a front panel and a follower with a first panel portion mounted for movement toward the front panel when a product is removed from the compartment. The first panel portion and the front panel substantially abut one another when the compartment is emptied of products and the first panel portion and the rear panel substantially abut one another when the compartment is filled with products. The follower is guided along the bottom panel by a guide member which extends from the follower into a slot in the bottom panel. Such guide member has a mechanism for modifying its width to compensate for slot/guide member wear. Vertically adjacent compartments are staggered so that substantially the entirety of at least the lower compartment is readily visible.

Rabas, U.S. Pat. No. 5,855,281, discloses a product display system which includes a basic unit including a track, a front wall, a back wall and a side member. The basic unit is easily assembled and disassembled. Two or more basic units can be ganged together to created customized displays to accommodate a wide varies of products of various sizes.

Hardy, U.S. Pat. No. 6,041,720, discloses a system for organizing and displaying items on a gondola shelf system comprising a gondola shelf connected to at least one vertical upright, the shelf including a front and a rear portion, a rail extending along and affixed to the front portion of the shelf, the rail comprising, a rail shelf surface extending longitudinally along the front portion of the shelf, the rail shelf surface including a first tongue extending from the rail shelf surface; a rail groove surface extending substantially perpendicular from the rail shelf surface, the rail groove surface including a first groove extending along the groove surface; and a display apparatus slidably engaged with the front rail, the display apparatus comprising a second tongue and a second groove, the first tongue engaging the first groove and the second tongue engaging the second groove.

Nagel, U.S. Pat. No. 6,745,906, discloses an adjustable width product display system that is comprised of a wire rack for supporting display products. At each end of the rack is a molded plastic base member having an upwardly opening recess for the reception of a cross bar element of the product support rack. Each base element is also provided with a pair of downwardly opening grooves of partially circular cross section, for the adjustable reception of transverse base elements of wire side supports. The side supports can be adjustably positioned to accommodate display product of various width. In many cases, a spring driven pusher sled may be provided on the display rack, and the base members are formed with one or more slots for the reception and anchoring of the free end of one or more pusher springs for driving the sled. The plastic base members are designed to accommodate vertical snap-in assembly of the rack and side supports into their respective grooves, to facilitate assembly. The base members are easily modified to include tongue-like extensions, enabling base members to be snapped onto guide strips provided at the front of display shelving, and also to be supported between front and back support rails, for example in a freezer display environment.

Caterinacci, U.S. Pat. No. 6,749,071, discloses a merchandise display device for dispensing and displaying digital media cases. Digital media cases are inserted vertically into the opening between the front panel and the lateral supports. This opening limits the number of cases which can be removed and/or inserted at one time. The width of the opening allows only two cases to be inserted or removed at a time, to deter theft. The opening, however, still allows for easy access when removing or inserting the cases. A replaceable pusher is attached to the back wall of the unit to bias the digital media cases toward the front panel. The display units are broken into two separate components, a right and left side. The components allow for flexibility in arranging the display system, depending on the need of the vendor. The invention provides a storage display system which continuously maintains the organized orientation of digital media cases, displays the covers of these cases, permits easy access and use of the stored objects and allows for flexibility so that the storage units are easy to install, reconfigure, and remove.

Thalenfeld, U.S. Pat. No. 6,769,552, discloses a product pusher device comprising an elongated guide track and a pusher sled slidably guided along the track for urging product packages forward on a display shelf. The pusher sled incorporates a housing for containing a coiled strip spring element. The end extremity of the spring is anchored at the forward end of the guide track, and the coiled body spring is confined within the housing at the back of the sled. By constructing the sled housing with an open bottom, assembly is greatly facilitated by allowing the spring to be anchored on the guide track independently of the sled and thereafter allowing the sled to be lowered over the coiled body of the spring and pressed downward to be snapped into assembled position on the guide track.

Hardy, WO02091885, discloses an integrated "T" assembly (500) combined into a single integrated assembly, a track portion along both sides of a divider. The T assembly may have a wide-base portion, which may include a spring-urged-pusher track, on one side of the divider and a narrow-base portion on the opposite side of the divider. An offset pusher may have an upper portion that is offset, via an angled offset portion, from a lower portion of the pusher. Additional supporting bases, any of which may include spring-urged-pusher tracks and/or a spring-urged pusher, may be used under a wide product. Left and right side finisher components may be paired with T assemblies near the sides of a merchandise-display shelf. The T assembly, base, and/or end finishers may be coupled to a front rail via a complimentary tongue and groove arrangement and/or a non-slidable engagement, such as mating teeth.

BRIEF SUMMARY OF THE INVENTION

This disclosure teaches certain benefits in construction and use which give rise to the objectives described below.

The present invention is a dispensing machine which includes an enclosure with a front door which may be opened for removing merchandise. The enclosure may be wall mounted or may be mounted to a surface as a stand-alone apparatus. Within the enclosure are mounted several merchandise supporting modules selectively engaged with selected slots of a shelf that is capable of being rolled out of the enclosure for loading the modules with merchandise boxes. The boxes are aligned on top of the modules in single file with a spring loaded pusher pressing on the last box in the line so that all of the boxes are pushed toward the front of the shelf and the enclosure. The first box in the line on each module may be ejected from the line of boxes by turning a knob at the front of the machine. When the knob is rotated it rotates a crank that raises a slide that pushes against the bottom of the first box thereby allowing it to jump over a barrier and fall to the front of the machine. The customer may then reach through a door to retrieve the box. When the door is opened it lowers a barrier strip so that the customer cannot reach into the modules and remove another of the boxes. The knob is fitted for making a loud noise so that retail store personnel are able to hear the ejection of products. If repetitive ejection noises are heard, this is an alarm to store personnel that a customer may be trying to defeat the system and may be a thief.

A primary objective inherent in the above described apparatus and method of use is to provide advantages not taught by the prior art.

Another objective is to provide a merchandise dispenser that prevents product theft by enclosing products within an enclosure.

A further objective is to provide such a dispenser with an adjustment feature that accommodates merchandise of various widths.

A still further objective is to provide such a dispenser with interlock for blocking stored merchandise when a dispensed item is made accessible to a consumer.

A still further objective is to provide such a dispenser that causes a tell-tail noise when an item is being dispensed.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
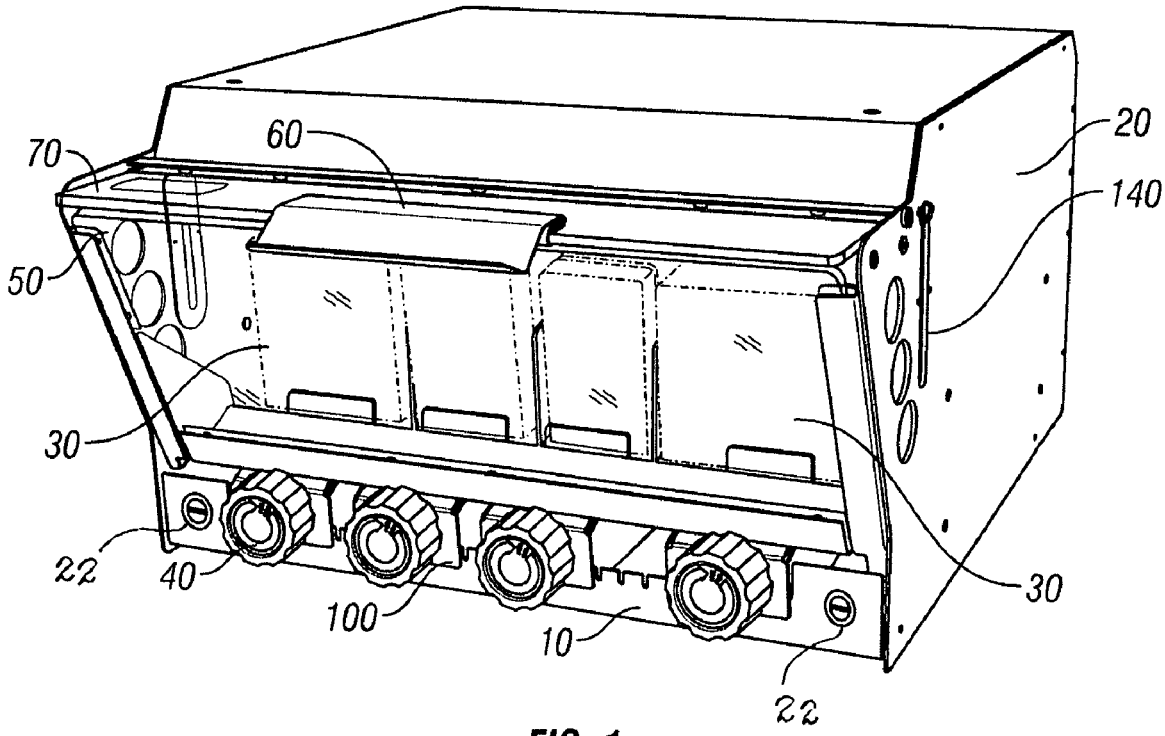
FIG. 1 is a perspective view of the presently described apparatus showing merchandise in position for dispensing.
Figure 2:
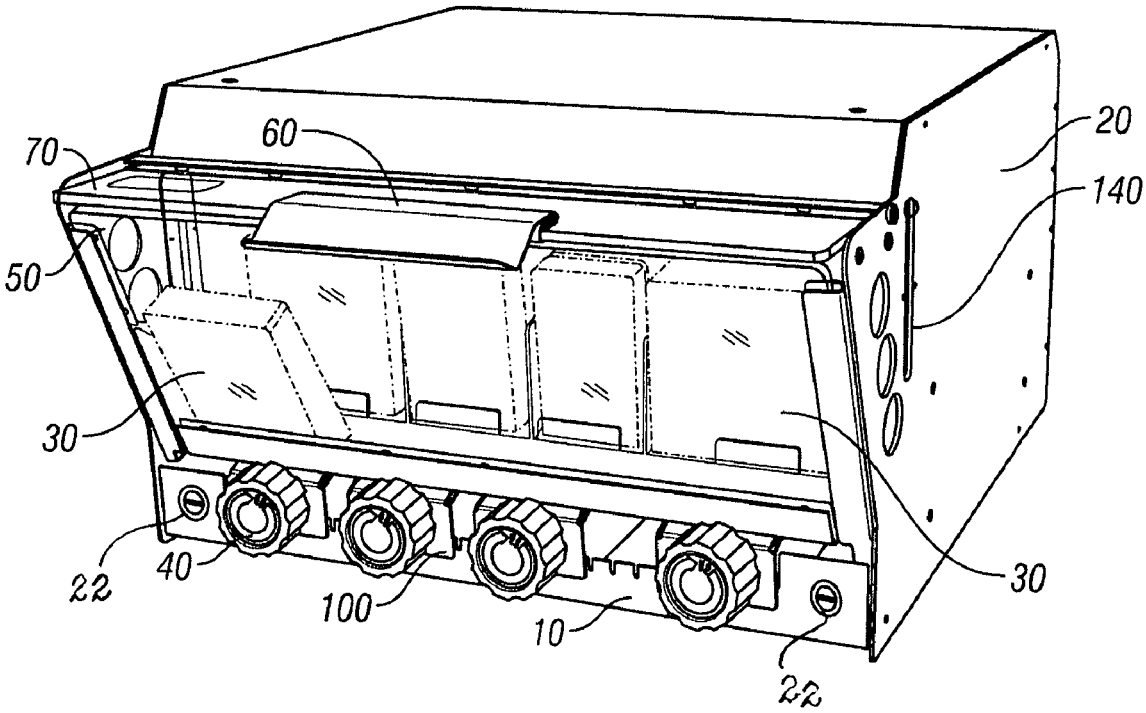
FIG. 2 is a perspective view thereof, showing the forward position assumed by a dispensed item.
Figure 3:
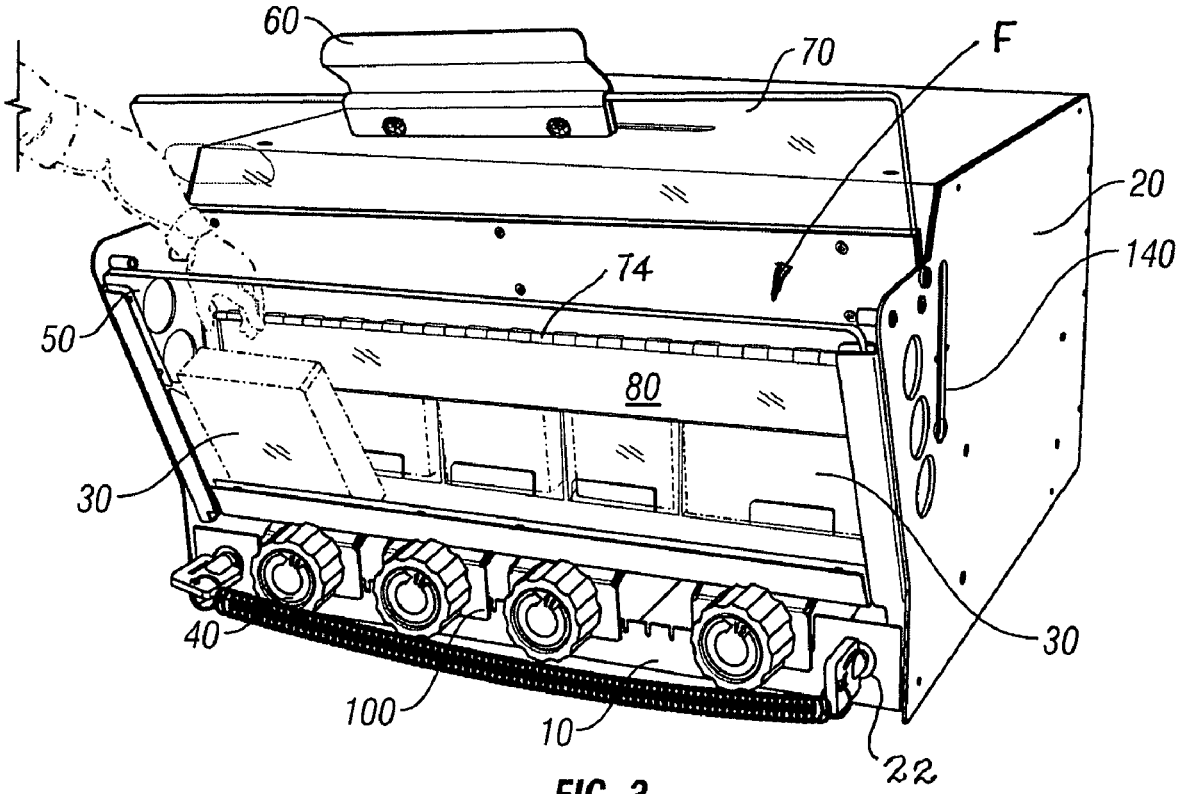
FIG. 3 is a perspective view thereof, showing a top access door in a raised and open attitude and illustrating how manual access to the dispensed merchandise is gained, and further showing how dual locks are opened to access a drawer.

Described now in detail is merchandise dispensing apparatus primarily designed for use in a retail store to dispense consumer items. FIG. 1 is a perspective view of the apparatus, a box structure having a plurality of walls enclosing and defining an interior space. The walls prevent access to the interior space from at least a frontal, side, top and bottom approaches. The apparatus has a storage shelf 10 mounted in a wrap-around enclosure 20. The enclosure 20 is preferably a sheet metal box with open front and rear, but closed on both of its sides and its top. Preferably, the shelf 10 closes the bottom of the enclosure 20. The enclosure 20 may be mounted on wall standards as is shown in the Mason patent application U.S. 2007/0080123 which is hereby incorporated herein by reference, and this would prevent access to the interior space from the rear approach. Alternately the apparatus may be placed on a shelf or otherwise secured within a retail establishment in a manner that restricts access to the rear and which eliminates the possibility of being moved by unauthorized persons. This may be accomplished by being bolted in place. In use, the shelf 10 is locked within the enclosure 20 so that merchandises for sale (referred to herein as merchandise box 30, are only accessible via a limiting dispensing process as will be described below. FIG. 2 shows one merchandise box 30 that has been dispensed by turning the leftmost knob 40 which dispenses box 30 to a forward position on the shelf 10 lying against a front glass plate 50. As shown in FIG. 3, a flat handle 60 is raised thereby lifting, from a closed attitude (FIGS. 1 and 2), into an open attitude (FIG. 3), a first movable wall, a top glass plate 70 mounted via a first hinge 71 (FIG. 5), so that a person's hand, shown in phantom line, is able to reach into the apparatus from above to retrieve the dispensed box 30. Notice that when the top glass plate 70 is raised, it simultaneously lowers a barrier strip 80, which may have a message printed on it such as "Stop Theft At Retail." Barrier strip 80, engaged with plate 70 by a second hinge 74, assumes a vertical position which blocks removal of any further of the merchandise boxes 30 other than the one dispensed as it bars access to any but the frontal portion F (FIG. 3) of the interior space. Therefore, only one box 30 can be dispensed with each revolution of each of the knobs 40.

Figure 4:
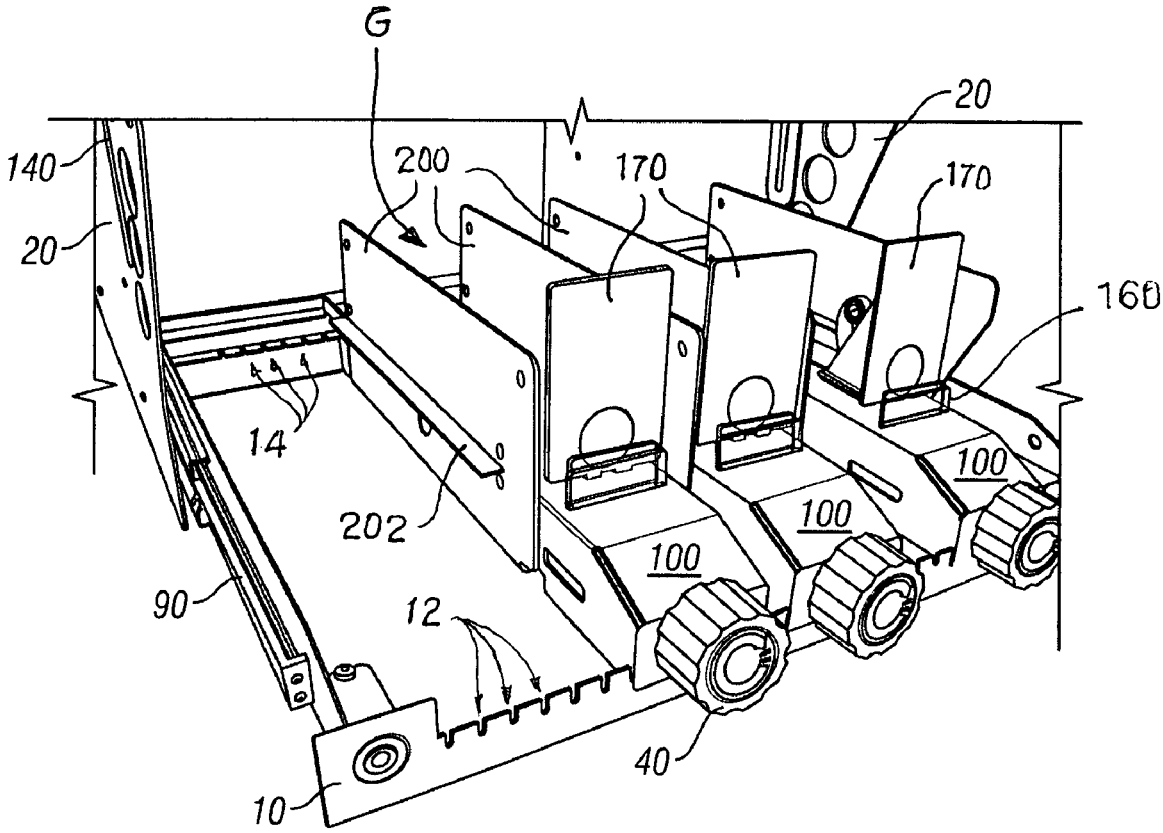
FIG. 4 is a perspective view thereof illustrating the shelf as drawn out to reveal three merchandise modules.

To gain access to the self for loading merchandise boxes 30, by operating personnel, key locks 22 are placed at left and at right lateral positions on the shelf 10 and when these locks are opened by keys, as shown in FIG. 3, the self 10 is able to be drawn out of the enclosure 20 on drawer glides 90 to a forward position, as shown in FIG. 4. In this view, the front glass plate 50 is removed in order to clearly show details. Three merchandise support modules 100 are shown mounted on shelf 10 in this view, and one or more further modules 100 may be mounted in the empty space shown on the left side of shelf 10.

Figure 5:
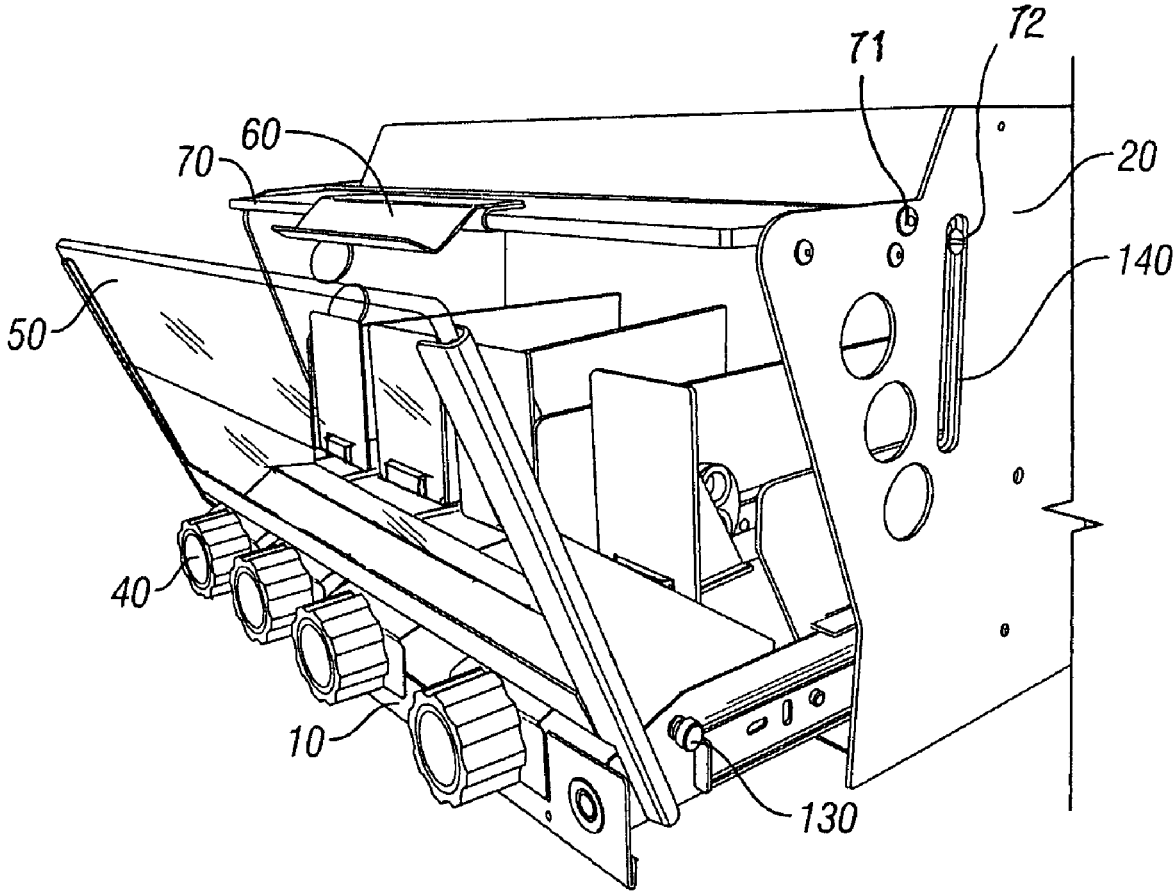
FIG. 5 is a right side perspective view thereof illustrating a security plate.

In FIG. 5 we see shelf 10 drawn partly out of enclosure 20 with the front glass plate 50 mounted and held in place by thumbscrews 130; one on each side of shelf 10. Clearly, plate 50 cannot be removed when shelf 10 is fully inserted within enclosure 20 since thumbscrews 130 are not accessible at that time. Therefore, plate 50 provides a primary merchandise theft deterrent means in the present invention.

Figure 6:
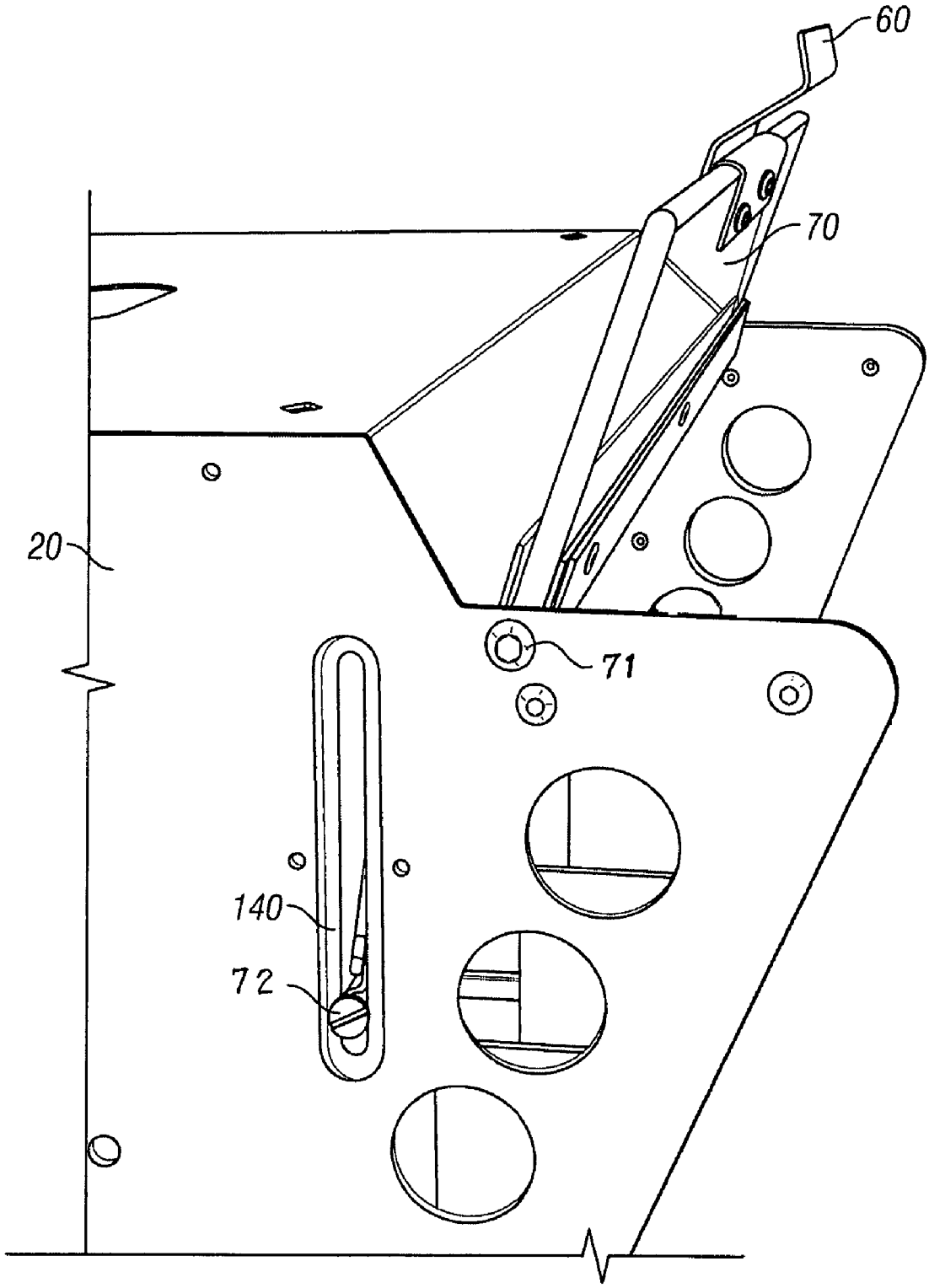
FIG. 6 is a left side perspective view thereof illustrating the top access door in its raised attitude.

In FIG. 6 top glass plate 70 is shown in its raised position. Plate 70 pivots on hinges secured by fasteners 71 on opposing sides of enclosure 20. On each side also, are vertical slots 140 within which ride screws 72 which control the attitude of barrier strip 80. Referring to FIG. 3 we see that barrier strip 80 is hinged via piano hinge 74 to top glass plate 70, so that when plate 70 is raised, sign 80 is rotated into the vertical position shown in FIGS. 3 and 6, and screws 72 are at the bottom of slots 140. Likewise, when plate 70 is lowered, as shown in FIG. 5, it also forces barrier strip 80 into a horizontal position where screws 72 are at the top of slots 140 (FIG. 5), uncovering merchandise boxes 30 which are mounted on modules 100 and thereby providing access for shelf 10 to be pulled out of enclosure 20 for loading further merchandise boxes 30.

Figure 7:
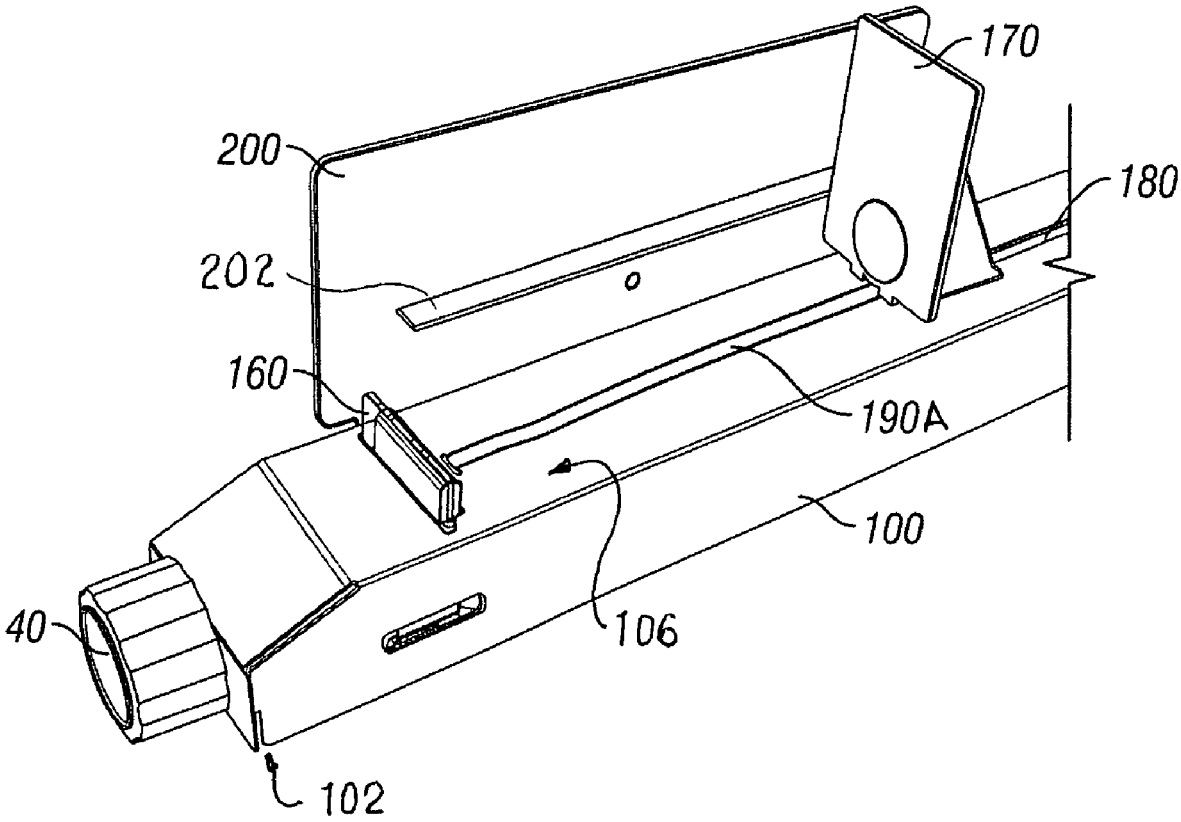
FIG. 7 is a perspective view of a module thereof.
Figure 8:
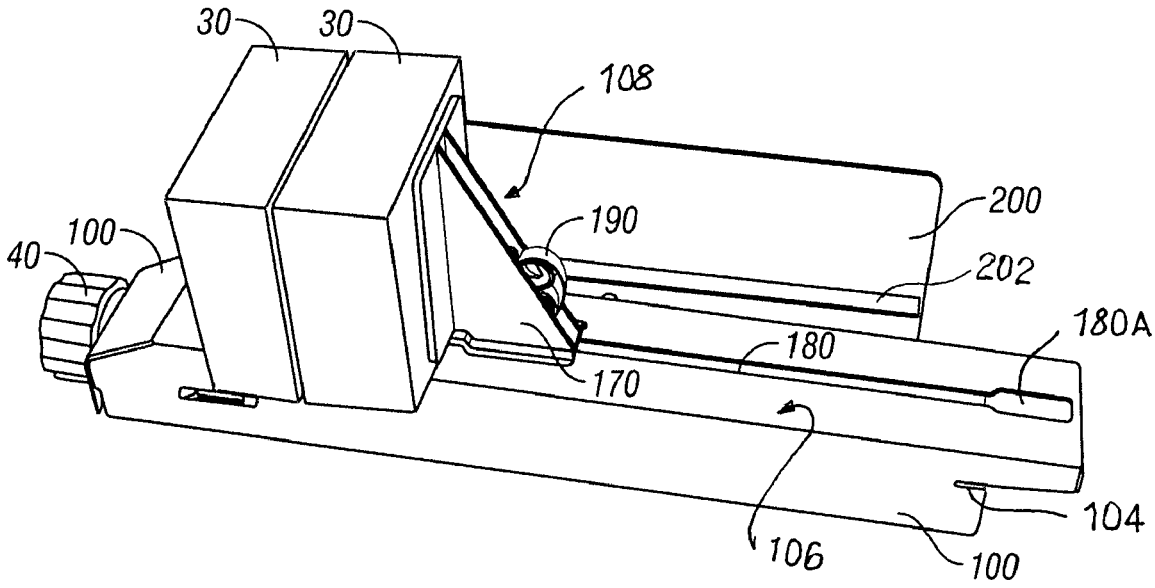
FIG. 8 is a perspective view of thereof illustrating how merchandise boxes are secured on the module.

In FIGS. 7-11 we will now describe modules 100 which are all identical. FIG. 7 shows a module 100 in its upright attitude as when mounted on shelf 10. Forward module slots 102 at the knob end of module 100 engage forward shelf slots 12 as shown in FIG. 4 thereby holding modules 100 in position on shelf 10. In FIG. 8 we see that module 100 provides rear module slots 104 which engage rear shelf slots 14 shown in FIG. 4. Therefore modules 100 are secured and immovable on shelf 10 from left to right and also front to back. In FIGS. 7 and 8 we see that a top surface 106 of module 100 has a longitudinal slot 180 which runs over a majority of the length of the module 100. Mounted in slot 180 is compression trolley 170 which is engaged with slot 180 via a wider portion 180A at the rear end of module 100, best shown in FIG. 8. Trolley 170 carries a clock spring 190 which is secured in spring slot 108. When trolley 170 is pressed toward the rear of module 100 clock spring 190 unreels and is wound tighter as a portion 190A of spring 190 reels out, as shown in FIG. 7. This provides the force for pressing merchandise boxes 30 toward the knob end of module 100. As shown in FIG. 8 one or more merchandise boxes 30 may be rested on top surface 106 and compressed between trolley 170 and a fixed stop plate 160 which is secured at a forward position on module 100 and protrudes above surface 106, as shown in FIG. 7. A side wall 200 is shown at one side of the module 100 and carries a flange 202 which is essentially at the level of top surface 106 so that with merchandise boxes 30 sitting on surface 106 and abutting side wall 200, boxes 30 also rest on flange 202. In one embodiment, the boxes 30 rest on flanges 202 on each side of boxes 30 but are thereby raised slightly above surface 106 so as not to interfere with the extended portion 190A of spring 190.

Figure 9:
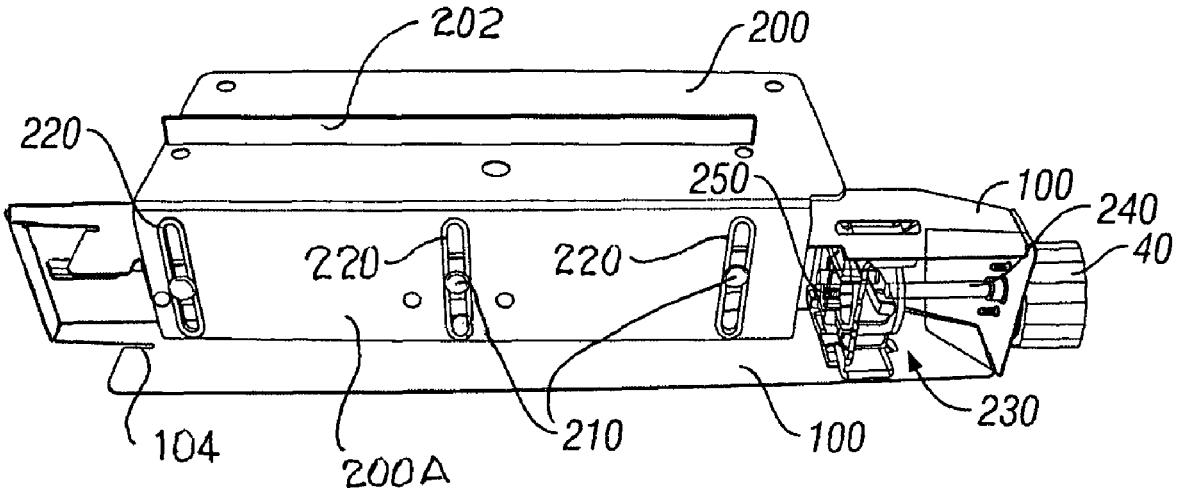
FIG. 9 is a bottom view of the module.

FIG. 9 is a bottom perspective view of module 100 showing the side wall 200 with flange 202 in a corresponding opposing position on side wall 200 as the flange 202 in FIG. 7. Flange 202 in FIG. 7 functions for controlling a merchandise box 30 on module 100, while the flange 202 in FIG. 9 controls a merchandise box 30 on an adjoining module as shown in FIG. 4. Side wall 200 provides three slots 220 which are formed on a bottom plate 200A of side wall 200 and which is integral with it. Three studs 210 grip bottom plate 200A while allowing it to move over a linear excursion limited by the length of slots 220 so that side wall 200 is able to be positioned laterally to accommodate merchandise boxes 30 of various widths. In setting up the modules 100 in shelf 10, as shown in FIG. 4, first a module 100 is selected for each size merchandise box 30 that is to be displayed, and each side wall 200 is adjusted laterally so as to contact one side of its respective box 30 when box 30 is laterally centered on surface 106 of its respective module 100. Working from left to right on shelf 10, the adjusted modules 100 are placed on shelf 10 and engaged with slots 12 and 14 in their respective strips, with the side wall 200 of each next module positioned against the merchandise box 30 of the module 100 to its right. Since modules 100 can only be positioned on shelf 10 in certain discrete locations dictated by the locations of slots 12 and 14, some experimentation in the order of placement of modules 100 may be required. In this manner, each line of merchandise boxes 30 will have a side wall 200 on both of its opposite vertical sides, forming a guide way G (FIG. 4) so that when a box 30 is dispensed the remaining boxes 30 are guided as they are pressed forward by trolley 170.

Figure 10:
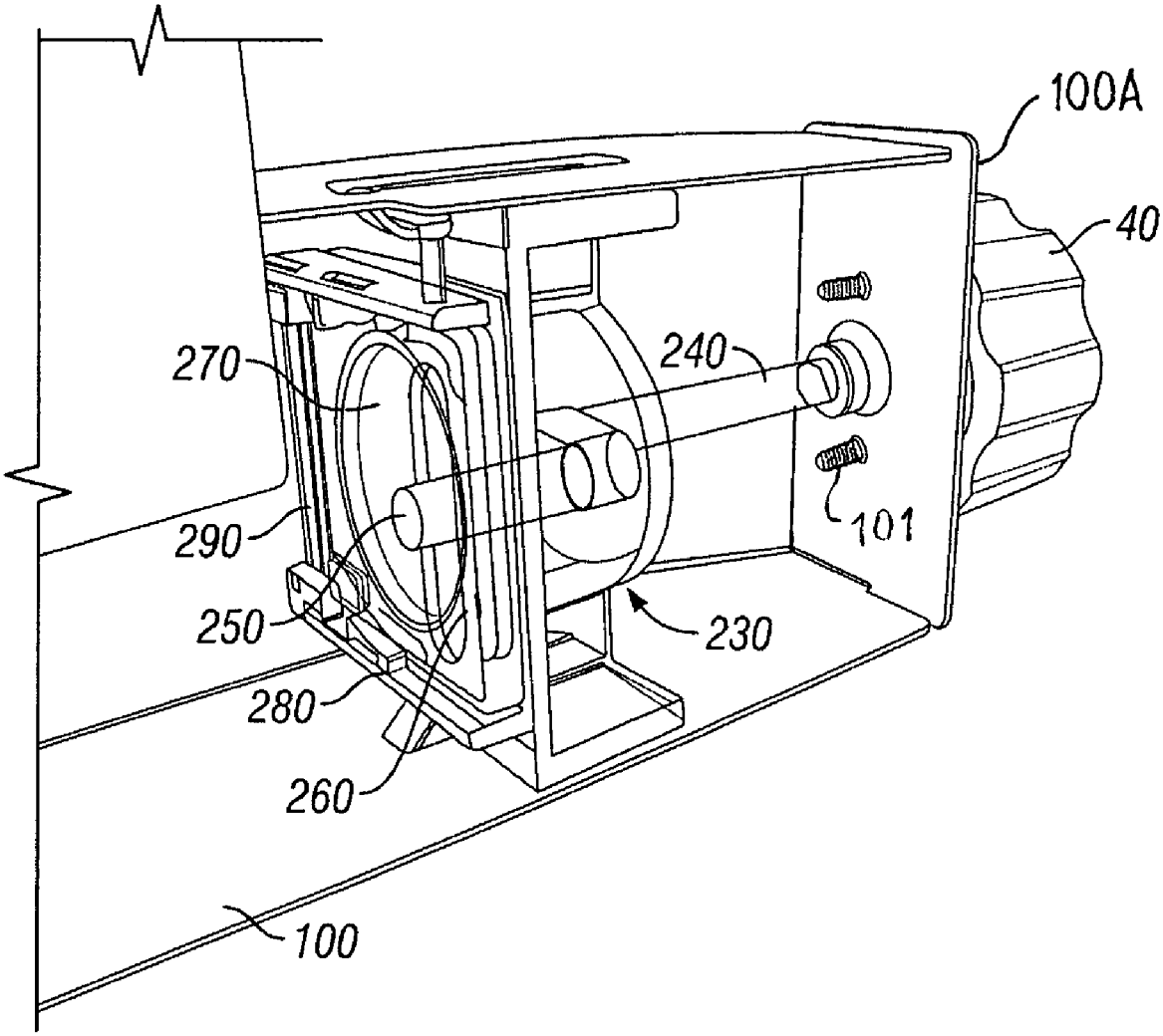
FIG. 10 is a close-up view of FIG. 9 showing details of an ejection mechanism thereof.
Figure 11:
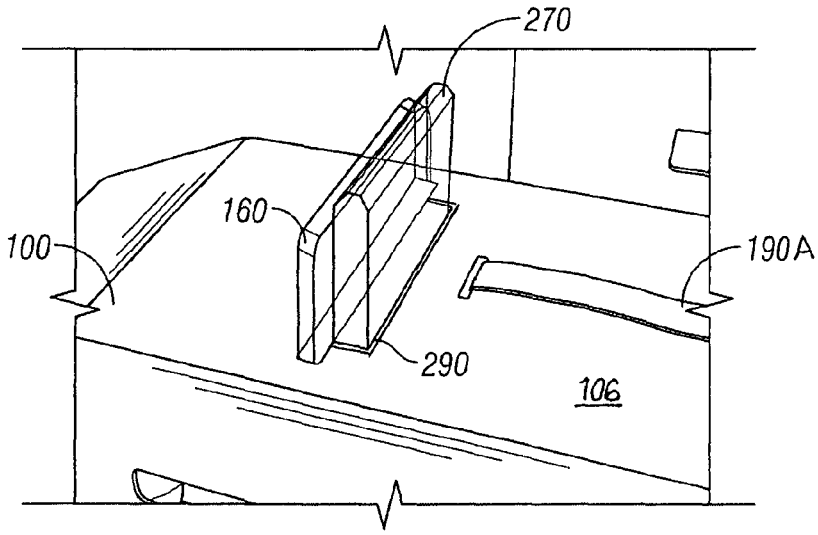
FIG. 11 is a close-up top perspective view thereof illustrating an ejection plate of the ejection mechanism in its raised position.
Figure 12:
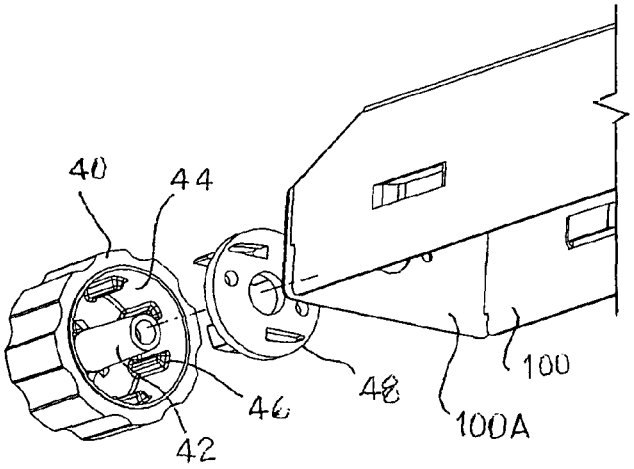
FIG. 12 is an exploded perspective view showing a knob, knob insert and a forward end of the module thereof.
Figure 13:
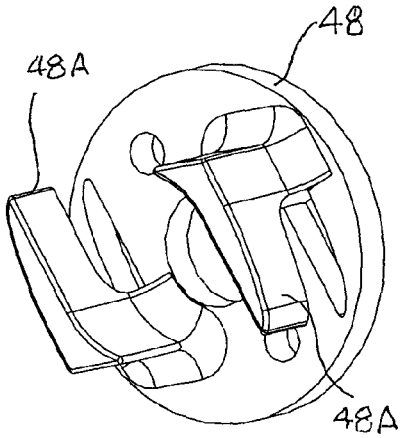
FIG. 13 is an enlarged perspective view of the knob insert.

FIG. 9 also shows the location of a merchandise ejector 230 which is housed within each module 100 so that merchandise boxes 30 on each module 100 may be dispensed independently of any other of the modules 100. FIG. 10 is a close-up view of mechanism 230 which is used to dispense the first merchandise box 30, i.e., the one that is in the most forward position on module 100 and so rests against stop plate 160 prior to being dispensed. Now referring to FIG. 10, when knob 40 is rotated, a shaft 240 which is joined to, and extends rearward from the knob 40, causes a crank 250 to move in a slot 260 in a movable ejector plate 270. The ejector plate 270 is therefore caused to slide linearly within ejector plate support 280 upwardly toward surface 106. As shown in FIG. 11, ejector plate 270 then moves through slot 290 in surface 106 of module 100 and protrudes at its highest above fixed stop 160 so that the first merchandise box 30, which is resting against fixed stop 160, is pushed above it. When this happens, the spring tension that is delivered to the first merchandise box 30 by trolley 170 through any intervening boxes 30 that may be in line behind the first box 30, delivers an ejecting force to the lifted first box 30 causing it to move forward in the apparatus coming to rest against front glass plate 50 as shown in FIG. 2, where it is ready to be manually removed through open top glass plate 70. The rotation of knob 40 continues so that ejector plate 270 moves at once down through slot 290 into the position shown in FIG. 10 thereby completing one ejection cycle. With the first box 30 and also ejector plate 270 no longer present, the next box 30 in line is forced to move up against fixed stop 160 and is therefore in position to be ejected whenever knob 40 is next rotated. Preferably, knob 40 is mounted on the front end 100A of module 100 by knob stem 42 which is best seen in FIG. 12. In FIG. 10 it is shown that knob stem 42 is joined with shaft 240. On an interior circular sidewall 44 of knob 40 are mounted ribs 46 as shown in FIG. 12. Mounted on front end 100A with screws 101 (FIG. 10) is knob insert 48. Insert 48, as best seen in FIG. 13, provides flexible cantilevered fingers 48A which extend into the interior of knob 40. When knob 40 is rotated, fingers 48A engage ribs 46 and are thereby bent and then released at least several times as knob 40 continues to rotate one revolution, and it is the release of spring energy stored in fingers 48A that makes a noise. Therefore, when a merchandise box 30 is dispensed, this tell-tale noise is produced alerting others in the vicinity that a dispensing action is taking place. The noise mechanism may be any means for producing an audible noise other then the preferred embodiment described here.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A merchandise dispensing apparatus providing theft deterrence comprising:

a box structure defined by a plurality of walls, the plurality of walls enclosing and defining an interior space within the box structure;

the plurality of walls positioned and configured to prevent access to the interior space from at least frontal, side, top and bottom approaches to the box structure;

a first movable wall of the plurality of walls joined to the box structure by a first hinge, the first hinge enabling the first movable wall to move between a closed attitude and an open attitude relative to the box structure, the open attitude of the first movable wall permitting manual access to a frontal portion of the interior space; and a barrier strip within the interior space and hingedly joined to the first movable wall by a second hinge wherein the barrier strip is forced into a vertical attitude when the first movable wall is raised, and the barrier strip is forced into a horizontal attitude when the first movable wall is lowered, the vertical attitude of the barrier strip preventing manual access to other than the frontal portion of the interior space.

2. The apparatus of claim 1 wherein the first movable wall is transparent, enabling visual access to the interior space when the barrier strip is in the first position and at least partly obscuring visual access to the interior space when the barrier strip is in the second position.

3. The apparatus of claim 2 further comprising a plurality of merchandise supporting modules, the merchandise supporting modules fixed in adjacent positions within the box structure, each of the merchandise supporting modules providing a merchandise ejector operably raising an ejector plate thereby operably lifting merchandise off the merchandise supporting modules.

4. The apparatus of claim 3 wherein the merchandise ejectors each comprise a rotatably mounted knob, the knob enabled for transmitting manual rotational action to a crank, the crank operable within a slot of the ejector plate, thereby directing the ejector plate in linear vertical motion.

5. The apparatus of claim 4 wherein each of the rotatably mounted knobs provides a noise making mechanism.

6. The apparatus of claim 3 wherein the merchandise supporting modules each provide a top panel with opposing side panels depending downwardly therefrom, at least one of the side panels engaging one of a plurality of slotted strips of the box structure, thereby fixing the merchandise supporting module in a selected position within the box structure.

7. A merchandise dispensing apparatus providing theft deterrence comprising:

a box structure defined by a plurality of walls, the plurality of walls enclosing and defining an interior space within the box structure;

the plurality of walls positioned and configured to prevent access to the interior space from at least frontal, side, top and bottom approaches to the box structure;

a first movable wall, of the plurality of walls, joined to the box structure by a first hinge, the first hinge enabling the first movable wall to move between a closed attitude and an open attitude relative to the box structure, the open attitude of the first movable wall sized for manual access to a frontal portion of the interior space; and a plurality of removable merchandise supporting modules, the merchandise supporting modules engaging fixed slotted strips of the box structure thereby selectively positioning the modules in adjacent, aligned, removably fixed locations within the interior space; each of the merchandise supporting modules providing a top panel for resting merchandise thereon, and a side wall movably secured to the merchandise supporting module; each adjacent pair of said side walls establishing a merchandise guideway terminating at a merchandise ejector proximal to the first movable wall, whereby merchandise ejected from each of the merchandise supporting modules is directed into the frontal portion in front of the respective merchandise supporting module in position to be manually removed from the frontal portion of the apparatus when the first movable wall is in the open attitude.

8. The apparatus of claim 7 further comprising a barrier strip within the interior space and hingedly joined to the first movable wall by a second hinge extending substantially parallel to the first hinge, the second hinge enabling the barrier strip to move between a first position allowing merchandise on the merchandise supporting module to be directed into the frontal portion when the first movable wall is in the closed attitude, and a second position when the first movable wall is in the open attitude, the second position of the barrier strip preventing manual access to other than said frontal portion of the interior space to prevent access to merchandise not already directed into the frontal portion.

9. The apparatus of claim 8 wherein the first movable wall is transparent, enabling visual access to the merchandise supporting modules when the barrier strip is in the first position and at least partly obscuring visual access to the merchandise supporting modules when the barrier strip is in the second position.

10. The apparatus of claim 7 wherein the merchandise supporting modules are fixed in adjacent positions within the box structure, each of the merchandise supporting modules providing a merchandise ejector operably enabled for raising and lowering an ejector plate for ejecting merchandise.

11. The apparatus of claim 10 wherein the merchandise ejectors each comprise a rotatably mounted knob, the knob enabled for transmitting manual rotational action to a crank, the crank operable within a slot of the respective ejector plate, thereby directing the ejector plate in linear vertical motion.

12. The apparatus of claim 11 wherein each of the rotatably mounted knobs provides a noise making mechanism operable when the knob is rotated.

13. A merchandise dispensing apparatus providing theft deterrence comprising:

a box structure defined by a plurality of walls, the plurality of walls enclosing and defining an interior space within the box structure; the plurality of walls positioned and configured to prevent access to the interior space from at least frontal, side, top and bottom approaches to the box structure; and a plurality of merchandise supporting modules within the interior space side by side adjacent one another across a width of the box structure, each said merchandise supporting module providing a top panel for resting merchandise thereon, a pair of opposing side panels depending downwardly from the top panel, and a movable side wall positioned adjacent to one of the side walls and parallel thereto; wherein adjacent pairs of the side walls establish merchandise guideways for orienting merchandise thereon towards a frontal portion of the interior space, each of the guideways terminating at a merchandise ejector adjacent the frontal portion, whereby merchandise ejected from the merchandise supporting modules is in position within the frontal portion of the box structure to be manually removed from the apparatus.

14. The apparatus of claim 13 wherein each merchandise ejector comprises a rotatably mounted knob positioned exterior to the box structure, the knob enabled for transmitting manual rotational action to a crank, the crank operable within a slot of an ejector plate, thereby directing the ejector plate in linear vertical motion for pressing on merchandise to thereby eject said merchandise.

15. The apparatus of claim 13 wherein at least one of the side panels of each one of the merchandise supporting modules engages at least one of a plurality of slotted strips of the box structure, thereby fixing the merchandise supporting modules in selected side by side positions within the box structure.

16. The apparatus of claim 14 wherein each of the rotatably mounted knobs provides a noise making mechanism operable when the knob is rotated.

17. The apparatus of claim 1, wherein the first movable wall comprises a first plate extending between side walls of the box structure over the frontal portion, the first plate comprising a handle for moving the front plate between the closed attitude and the open attitude for permitting access to the frontal portion, the barrier strip hingedly joined to the first plate opposite the handle such that the barrier strip is lowered into the vertical attitude adjacent the frontal portion.

18. The apparatus of claim 17, wherein the first plate is oriented generally horizontally in the closed attitude and is lifted about the first hinge to access the frontal portion.

19. The apparatus of claim 18, wherein the handle is located on a front edge of the first plate, the second hinge is located on a rear edge of the first plate and the first hinge is disposed on side edges of the first plate between the front and rear edges.

20. The apparatus of claim 18, wherein the plurality of walls comprise a front plate allowing observation of merchandise within the interior space through the front plate, the first plate contacting an upper edge of the front plate in the closed attitude.

* * * * *